US010735842B2

(12) United States Patent
Prasad et al.

(10) Patent No.: US 10,735,842 B2
(45) Date of Patent: Aug. 4, 2020

(54) WIRELESS CONNECTED JEWELLRY DEVICE

(71) Applicant: Teqnizan Inc, Hamel, MN (US)

(72) Inventors: Rama Prasad, Hamel, MN (US); Marlyn Anderson, St. Louis Park, MN (US)

(73) Assignee: Teanizan, Inc., Hamel, MN (US)

( * ) Notice: Subject to any disclaimer, the term of this patent is extended or adjusted under 35 U.S.C. 154(b) by 0 days.

(21) Appl. No.: 15/854,892

(22) Filed: Dec. 27, 2017

(65) Prior Publication Data

US 2019/0222914 A1 Jul. 18, 2019

Related U.S. Application Data

(60) Provisional application No. 62/452,915, filed on Jan. 31, 2017.

(51) Int. Cl.

| | |
|---|---|
| ***H04R 1/10*** | (2006.01) |
| ***A44C 15/00*** | (2006.01) |
| ***A44C 7/00*** | (2006.01) |

(52) U.S. Cl.

CPC ..... *H04R 1/1008* (2013.01); *A44C 7/003* (2013.01); *A44C 15/0015* (2013.01); *H04R 1/1016* (2013.01); *H04R 2201/107* (2013.01); *H04R 2420/07* (2013.01)

(58) Field of Classification Search

None

See application file for complete search history.

(56) References Cited

U.S. PATENT DOCUMENTS

| | | | |
|---|---|---|---|
| 7,536,150 | B2 | 5/2009 | Ryann |
| 8,086,288 | B2 | 12/2011 | Klein |
| 8,676,274 | B2 | 3/2014 | Li |
| 9,049,515 | B2 | 6/2015 | Clow |

(Continued)

FOREIGN PATENT DOCUMENTS

DE 102016110347 * 6/2016

OTHER PUBLICATIONS

English machine translation of DE 102016110347 (Year: 2016).*

*Primary Examiner* — James K Mooney

(57) ABSTRACT

A wireless connected device is disclosed. The wireless connected device includes one or more earrings, each earring includes one or more CASINGS coupled with an earlobe of an ear through a hook or a post with backing. The one or more casings in the one or more earrings includes a sound production system located outside a first ear canal and proximate to an intertragical notch of the ear. The one or more casings in the one or more earrings also includes a microphone device located proximate to the mouth and configured to receive voice signals. The one or more casings in the one or more earrings further includes a transceiver antenna located proximate to the ear and configured to transmit and receive wireless signals. The one or more casings in the one or more earrings further includes a plurality of transducers. Each of the plurality of transducer is configured to perform a corresponding function. The casings are metallized or decoratively treated to provide the jewellery aesthetics, but not interfere with the antenna or transducer function. The casings are interconnected with structurally robust and conductive, wire and flex sub-assembly.

16 Claims, 6 Drawing Sheets

(56) References Cited

U.S. PATENT DOCUMENTS

| | | | | |
|---|---|---|---|---|
| 9,084,054 | B2 | 7/2015 | Prelogar | |
| 2007/0058831 | A1 | 3/2007 | Rie | |
| 2008/0146892 | A1* | 6/2008 | LeBoeuf | G16H 50/30 600/300 |
| 2008/0226094 | A1* | 9/2008 | Rutschman | H04M 1/6066 381/79 |
| 2013/0343562 | A1 | 12/2013 | Amsalem | |
| 2015/0110319 | A1* | 4/2015 | Mimbs | H04R 25/02 381/322 |
| 2019/0141428 | A1* | 5/2019 | Gampe | H04R 1/1016 |

* cited by examiner

WIRELESS CONNECTED JEWELLRY DEVICE

PRIORITY CLAIM

The present invention claims priority to a U.S. provisional patent application Ser. No. 62/452,915 filed on Jan. 31, 2017, disclosure of which is incorporated herein in its entirety at least by reference.

BACKGROUND

The present invention relates to jewellery, and more particularly, to a wireless connected jewellery device.

Jewellery is a personal decorative ornament that is used by a person to enhance appearance of the person. The jewellery can be worn on the body of the person or on clothes of the person. Different types of jewellery are worn at different parts of the body. For example, a necklace is worn over a neck to enhance the appearance of the neck and face, an earring is worn in ears to enhance the appearance of the ears and face, and a bracelet is worn on the hand to improve the appearance of the hand. Similarly, a brooch is worn on the clothes near to a chest of the person to improve the overall appearance of the person.

In recent past, people have attempted to use jewellery for different or additional applications. In some applications, people have attempted to design an electronic device as a jewellery. In other applications, people have attempted to incorporate different systems in the jewellery to use the jewellery for additional applications. Some of such applications having the different systems include a bracelet that operates as an activity tracker, and rings on the finger that can operate as a notification or alert device by buzzing. However, such jewellery can have limited function, be large, heavy, uncomfortable, and unattractive to wear, creating barriers to adoption by the consumer and not delivering on the full potential of the device.

One such example is a pair of earring incorporating a wireless earphone that includes an in-ear speaker earbud, a casing including components of the wireless earpiece and hanging from the ear, a fastener to couple the wireless earpiece to the ear, a main body to couple the fastener to the in-ear speaker earbud, and a microphone portion at one end of the casing. However, such earphone isolates the person from the surroundings and results in accident. Furthermore, wearing such earrings with the in-ear speaker earbuds results in ear pain for the person. Different people have different ear sizes, due to which the in-ear placement of the speaker earbuds leads to improper fit of the in-ear speaker buds in different people. Additionally, due to the in-ear placement of the Bluetooth earbuds, the Bluetooth wireless wave source is closer to the brain of the person, which may lead to prolonged exposure to electro-magnetic waves resulting in health issues. Positioning of the microphone in such wireless earpiece requires the person to move the microphone closer to the mouth each time for speaking and maintain such position during the call. Such positioning and movement of the microphone requires human intervention that is uncomfortable and awkward.

Hence, the one or more aforementioned issues prevent people from using the wireless earpiece when needed, due to which these issues need to be addressed.

BRIEF DESCRIPTION

In accordance with one embodiment of the disclosure, a wireless connected jewellery device is provided. The wireless connected jewellery device includes a pair of earrings. The pair of earrings includes a first earring. The first earring includes a first casing. The first casing physically coupled with a first earlobe of a first ear through a hook or post with backing. The first casing includes a sound production system located outside a first ear canal on the first earlobe and proximate to an intertragical notch of the first ear. The first earring also includes a second casing operatively coupled with the first casing using a first conducting material. The second casing includes a first microphone device located proximate to the first ear and configured to receive voice signals. The first earring further includes a transceiver antenna proximate to the first ear and configured to transmit and receive wireless signals. The transceiver antenna can be located in a third smaller casing which resides between the first and second casing. The pair of earrings also includes a second earring. The second earring includes a third casing coupled with a second earlobe of a second ear and a fourth casing coupled with the third casing using a second conducting material. The third casing and the fourth casing includes a plurality of transducers is configured to perform a corresponding one or more functions.

In accordance with another embodiment of the present disclosure, the wireless connected jewellery device is provided. The wireless connected jewellery device includes one or more earrings, each earring comprising one or more casings coupled with a first earlobe of an ear. The one or more casings in the one or more earrings includes a sound production system located outside a first ear canal and proximate to an intertragical notch or proximate to the tragus of the ear. The one or more casings in the one or more earrings also includes a microphone device located proximate to the ear and is configured to receive voice signals. The one or more casings in the one or more earrings further includes a transceiver antenna located proximate to the ear and is configured to transmit and receive wireless signals. The one or more casings in the one or more earrings further includes a plurality of transducers. Each of the plurality of transducers is configured to perform a corresponding function.

To further clarify the advantages and features of the present invention, a more particular description of the invention will follow by reference to specific embodiments thereof, which are illustrated in the appended figures. It is to be appreciated that these figures depict only typical embodiments of the invention and are therefore not to be considered limiting in scope. The invention will be described and explained with additional specificity and detail with the appended figures.

BRIEF DESCRIPTION OF THE DRAWINGS

The disclosure will be described and explained with additional specificity and detail with the accompanying figures in which.

DETAILED DESCRIPTION

Figure 1A:
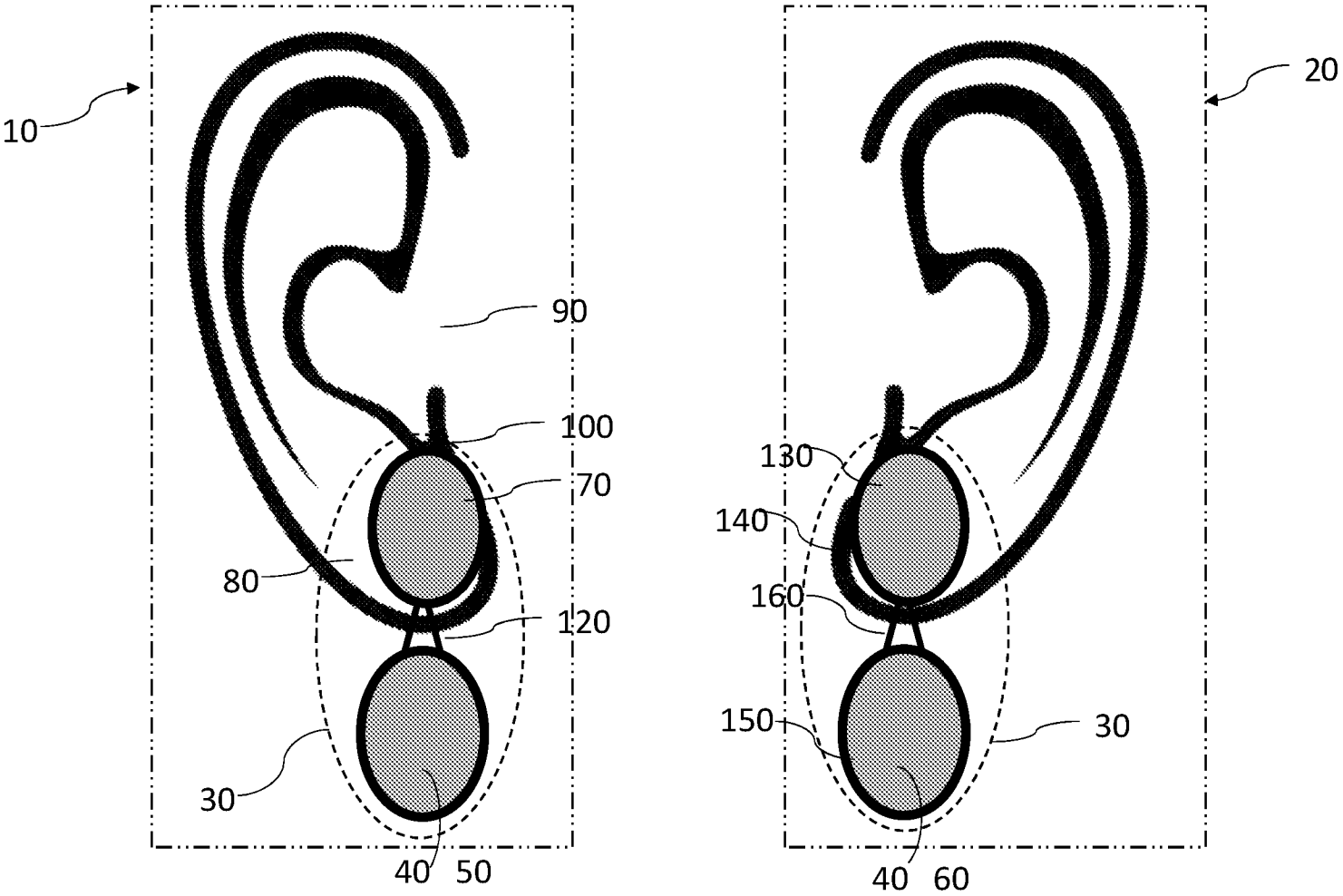
FIG. 1A illustrates a schematic representation of ears with a pair of earrings in accordance with an embodiment of the present disclosure and FIG. 1B illustrates a schematic representation of a pair of earrings in accordance with an embodiment of the present disclosure where the earrings are coupled to a Bluetooth mesh network.

For the purpose of promoting an understanding of the principles of the invention, reference will now be made to the embodiment illustrated in the figures and specific language will be used to describe them. It will nevertheless be understood that no limitation of the scope of the invention is thereby intended. Such alterations and further modifications in the illustrated system, and such further applications of the principles of the invention as would normally occur to those skilled in the art are to be construed as being within the scope of the present invention.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or sub-systems or elements or structures or components preceded by "comprises . . . a" does not, without more constraints, preclude the existence of other devices, sub-systems, elements, structures, components, additional devices, additional sub-systems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this invention belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relate to a wireless connected jewellery device is provided. The wireless connected jewellery device includes a pair of earrings. The pair of earrings includes a first earring. The first earring includes a first casing. The first casing physically coupled with a first earlobe of a first ear. The first casing includes a sound production system located outside a first ear canal on the first earlobe and proximate to an intertragical notch of the first ear.

The first earring also includes a second casing operatively coupled with the first casing using a first conducting material. The second casing includes a first microphone device located proximate to the first ear and is configured to receive voice signals. The first earring further includes a transceiver antenna proximate to the first ear and is configured to transmit and receive wireless signals. The pair of earring also includes a second earring. The second earring includes a third casing coupled with a second earlobe of a second ear and a fourth casing coupled with the third casing using a second conducting material. The third casing and the fourth casing includes a plurality of transducers is configured to perform a corresponding one or more functions.

FIG. 1A illustrates a schematic representation of a first ear 10 and a second ear 20 with a wireless connected jewellery device 30 in accordance with an embodiment of the present disclosure. The wireless connected jewellery device 30 includes the pair of earrings 40. The pair of earrings 40 includes a first earring 50 and a second earring 60. The first earring 50 includes a first casing 70 physically coupled with a first earlobe 80 of the first ear 10 through a hook or post with backing. The first casing 70 is located outside a first ear canal 90 on the first earlobe 80 and proximate to an intertragical notch 100 of the first ear 10.

The first earring 50 also includes a second casing 110, where the second casing 110 is operatively coupled with the first casing 70 using a first conducting material 120. The pair of earrings 40 also includes a second earring 60. The second earring 60 includes a third casing 130 coupled with a second earlobe 140 of the second ear 20 and a fourth casing 150 coupled with the third casing 130 using a second conducting material 160. Conductive material 120 and 160 connecting the casings in the two earrings may include components on conducting material such as wireless antenna and the conductive material may be enclosed in a smaller casing.

Figure 2:
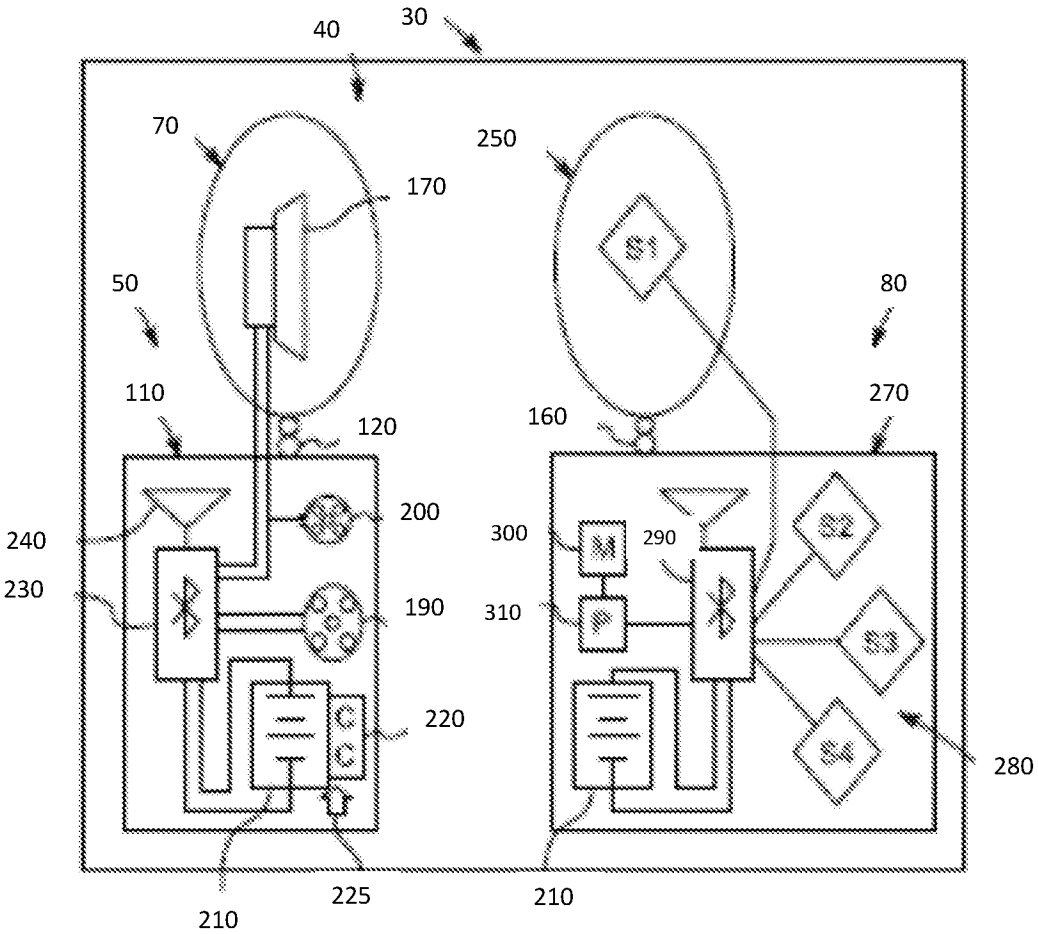
FIG. 2 illustrates a detailed schematic representation of a wireless connected jewellery device in accordance with an embodiment of the present disclosure.

FIG. 2 illustrates a detailed schematic representation of a wireless connected jewellery device 30 in accordance with an embodiment of the present disclosure. The wireless connected jewellery device 30 includes the pair of earring 40. The pair of earrings 40 includes the first earring 50 and the second earring 60. In one embodiment, the pair of earrings 40 may include a pair of dangler earrings, a pair of crawler earrings, a pair of drop earrings or a pair of chandelier earrings. The first earring 50 includes the first casing 70 and the second casing 110, where the second casing 110 is operatively coupled with the first casing 70 using a first conducting material 120. In one embodiment, the first conducting material 120 may include a litz wire or a flexible board with antenna component. The first casing 70 includes a sound production system 170 located outside the first ear canal 90 on the first earlobe 80 and proximate to an intertragical notch 100 of the first ear 10. In one embodiment, the sound production system 170 may be located outside of the first ear canal 90 proximate to a tragus of the first ear 10. In another embodiment, the sound production system 170 may be tuned to be audible to a user only. In one embodiment, the sound production system 170 in the first casing 70 may be positioned with facing up and towards the first ear canal 90.

Figure 3:
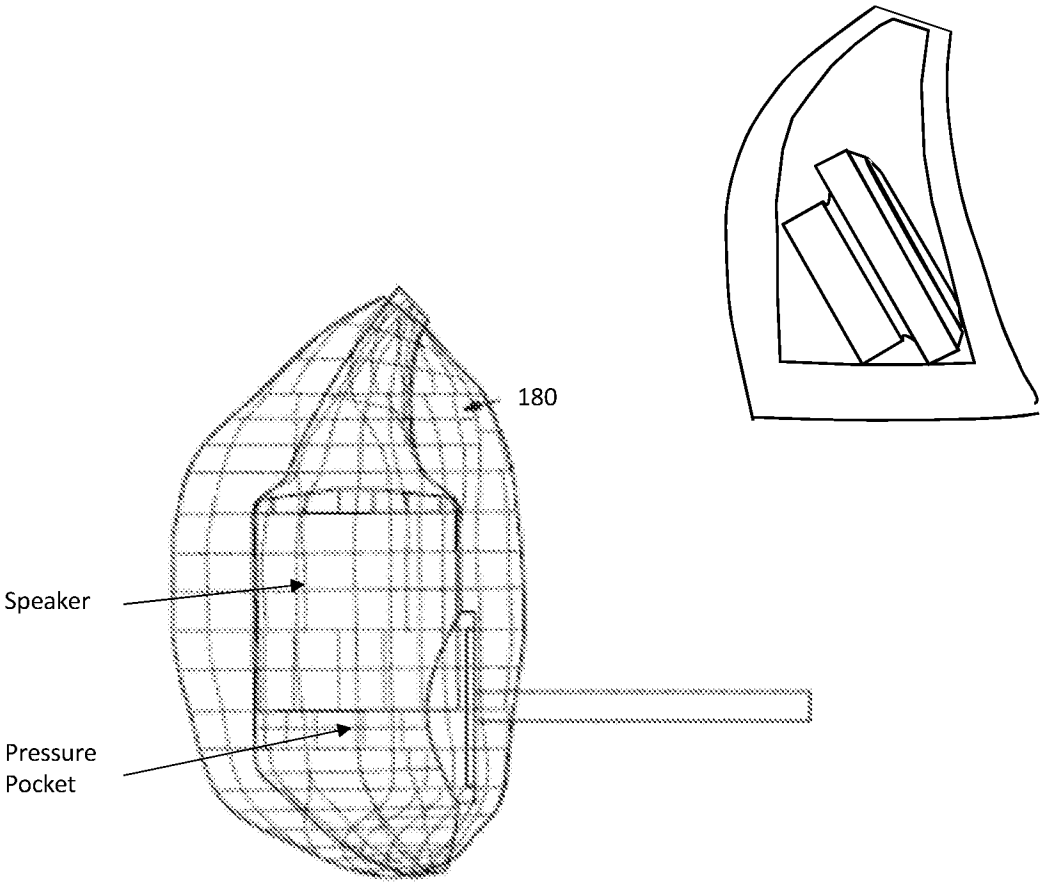
FIG. 3 illustrates an audio channel design of an earring in accordance with an embodiment of the present disclosure.

In some embodiments, the first casing 70 may include an audio channel design 180 configured to contain and direct a plurality of sound waves generated by the sound production system 170 to the intertragical notch 100 as shown in FIG. 3. In one embodiment, the sound production system may be a cylindrical, a disc, a flat array or any other shaped sound production system 170. The audio channel containing and directing the sound waves is optimized uniquely for the given sound production unit shape.

Referring back to FIG. 2, the second casing 110 includes a first microphone device 190 located proximate to the first ear 10. The first microphone device 190 is configured to receive voice signals. In one embodiment, the first microphone device 190 may be located facing forward on the first casing 70. In a specific embodiment, the second casing 110 of the first earring 50 may include a second microphone device 200. The second microphone device 200 is configured to enable noise cancellation by isolating the noise from first microphone device 190 for clear voice signals.

In some embodiments, the second casing 110 of the first earring 50 may include a rechargeable battery 210 and an onboard charging circuit 220. In such embodiments, the onboard charging circuit 220 may be operatively coupled to the rechargeable battery 210 and may be configured to transfer power from a power source to the rechargeable battery 210. In one embodiment, the rechargeable battery 210 may be recharged independent of the first earring 50. In another embodiment, the onboard charging circuit 220 may include a universal serial bus (USB) port 225 or a pin charging system 225. In a specific embodiment, the rechargeable battery 210 may be positioned behind the onboard charging circuit 220.

Figure 1B:
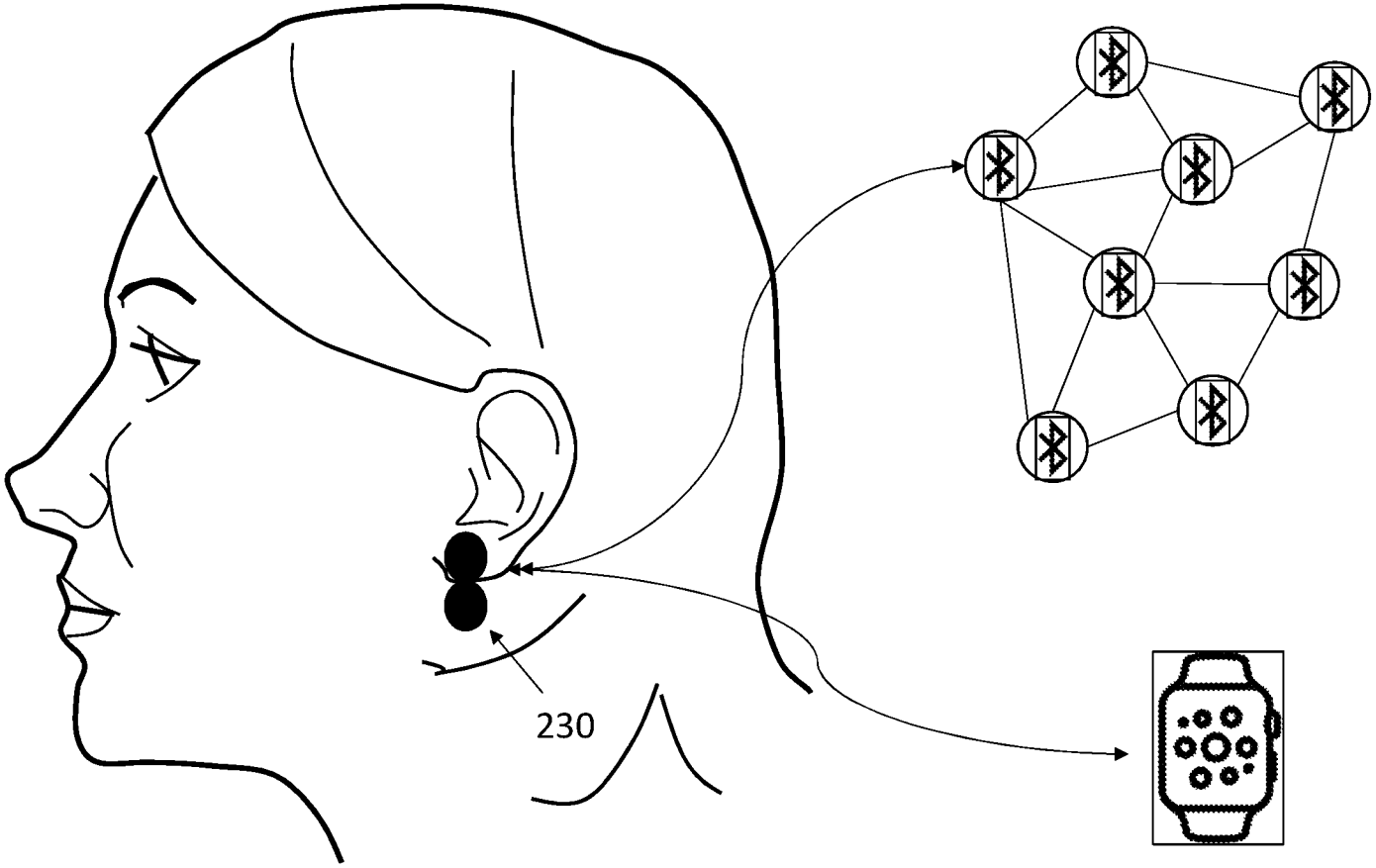

In one embodiment, the second casing 110 of the first earring 50 may include a Bluetooth device 230. The Bluetooth device 230 may be communicatively coupled to an external communication device. In one embodiment, illustrated by FIG. 1B, the external communication device may include mobile phone or a wearable device. In another embodiment, the Bluetooth device 230 may be communicatively coupled to a Bluetooth mesh network.

In addition, the first earring 50 also includes a transceiver antenna 240 proximate to the first ear 10. The transceiver antenna 240 is configured to transmit and receive wireless signals. In one embodiment, the transceiver antenna 240 may be located proximate to the first ear 10 at a distance of at least 1 inch from the brain. In another embodiment, the transceiver antenna 240 may be located on the first conducting material 120. In yet another embodiment, the transceiver antenna 240 may be located on the flexible board. In yet another embodiment, the transceiver antenna 240 may be enclosed in one or more casings to avoid disturbances.

Furthermore, the second earring 60 includes a third casing 250 coupled with a second earlobe 140 of the second ear 20 and a fourth casing 270 coupled with the third casing 250 using the second conducting material 160. In one embodiment, the second conducting material 160 may include a litz wire or a flexible board. In a specific embodiment, the first conducting material 120 and second conducting material 160 may include a ring shape or a bead shape to reduce twisting and movement of the pair of earrings 40 during walking and may house the antenna.

The third casing 250 and the fourth casing 270 includes a plurality of transducers 280 configured to perform corresponding one or more functions. In one embodiment, the plurality of transducers 280 may include one or more biometric sensors. The one or more biometric sensors convert a biometric measurement of a person into an electrical signal. In a specific embodiment, the one or more biometric sensor may include a face recognition sensor, a fingerprint sensor, a hand geometry sensor, an Iris recognition sensor and a voice recognition sensor.

In another embodiment, the plurality of transducers 280 may include one or more environmental sensors. The one or more environmental sensors convert environmental parameters such as air, temperature, humidity or pressure to an electrical signal. In a specific embodiment, the one or more environmental sensors may include such a temperature sensor, a humidity sensor, a CO2 level sensor or an accelerometer.

In yet another embodiment, the plurality of transducers 280 may include a haptic sensor configured to enable the connection between the wireless connected jewellery device and the external communication device. In such embodiments, the haptic sensor may be located at any of the casings of the pair earrings 40. In one embodiment, the plurality of transducers 280 includes a heart rate sensor, a skin sensor or an activity monitoring sensor.

In some embodiments, the fourth casing 270 of the second earring 60 may include a low energy Bluetooth device 290. The low energy Bluetooth device 290 is configured to enable the communication between the pair of earrings 40.

In a specific embodiment, the second casing 270 may include a memory 300 configured to store data from a duration of time obtained from the plurality of transducers 280. In another embodiment, the second casing 270 may include a processor 310 configured to process data obtained from the plurality of transducers 280.

In some embodiments, one or more components of the second casing 110 of the first earring 50 may be located in the first casing 70 of the first earring 50. Similarly, in another embodiment, one or more components of the fourth casing 270 of the second earring 60 may be located in the third casing 250 of the second earring 60.

In one embodiment, the first casing 70 and the second casing 110 of the first earring 50 and the third casing 250 and the fourth casing 270 of the second earring 60 may be composed of a specially formulated plastic with custom optimized coatings.

Figure 4:
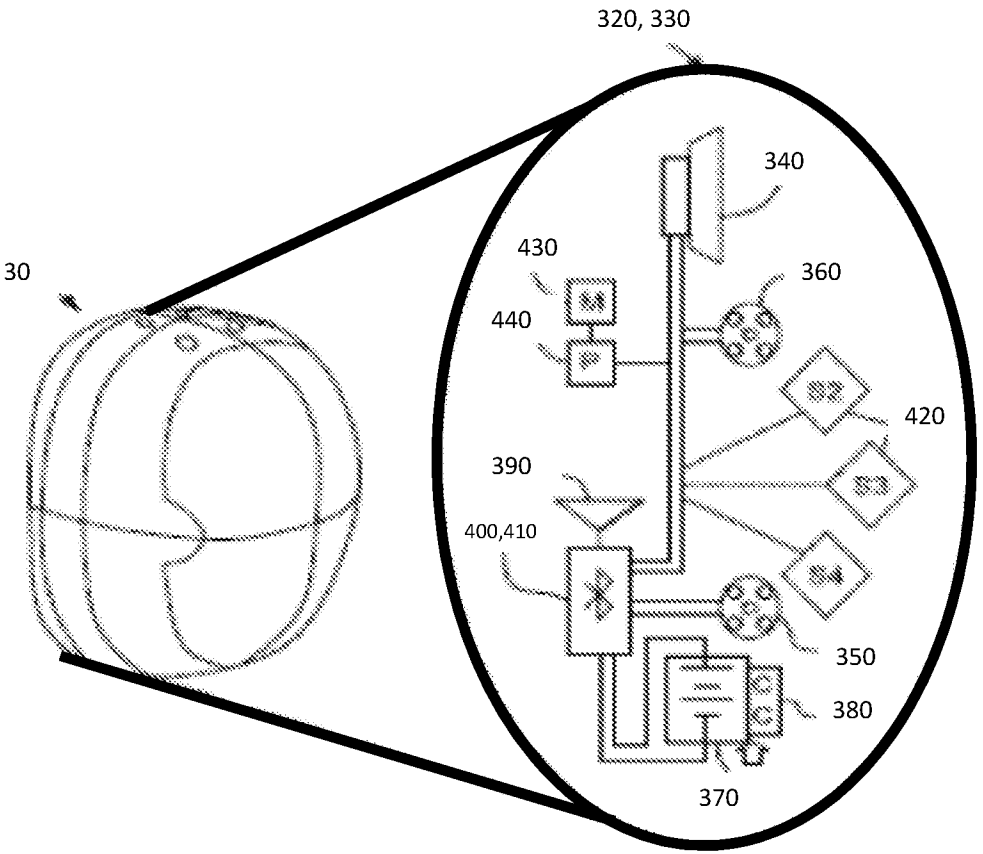
FIG. 4 illustrates a schematic representation of an exemplary wireless connected jewellery device in accordance with an embodiment of the present disclosure.

FIG. 4 illustrates a schematic representation of an exemplary wireless connected jewellery device 30. The wireless connected jewellery device 30 includes one or more earrings 320. In one embodiment, the one or more earring 320 may include a stud earring, a hoop earring or a huggy earring. Each of the one or more earring 320 includes one or more casings 330 coupled with a first earlobe 80 of a first ear 10. The one or more casings 330 includes a sound production system 340 substantially similar to the sound production system 170 of FIG. 2. The one or more casings 330 also includes a first microphone device 350 substantially similar to the first microphone device 190 of FIG. 2. In one embodiment, the one or more casings may include a second microphone device 360 substantially similar to the second microphone device 200 of FIG. 2. In another embodiment, the one or more casings may include a rechargeable battery 370 substantially similar to the rechargeable battery 210 of FIG. 2. In yet another embodiment, the one or more casings may include an onboard charging circuit 380 substantially similar to the onboard charging circuit 220 of FIG. 2.

Also, the one or more casings include a transceiver antenna 390 substantially similar to the transceiver antenna 240 of FIG. 2. In one embodiment, the one or more casings may include a Bluetooth device 400 substantially similar to the Bluetooth device 230 of FIG. 2. In another embodiment, the one or more casings may include a low energy Bluetooth device 410 substantially similar to the low energy Bluetooth device 290 of FIG. 2.

Furthermore, the one or more casings includes a plurality of transducers 420 substantially similar to the plurality of transducers 280 of FIG. 2. In one embodiment, the one or more casings may include a memory 430 substantially similar to the memory 300 of FIG. 2. In another embodiment, the one or more casings may include a processor 440 substantially similar to the processor 310 of FIG. 2.

Figure 5:
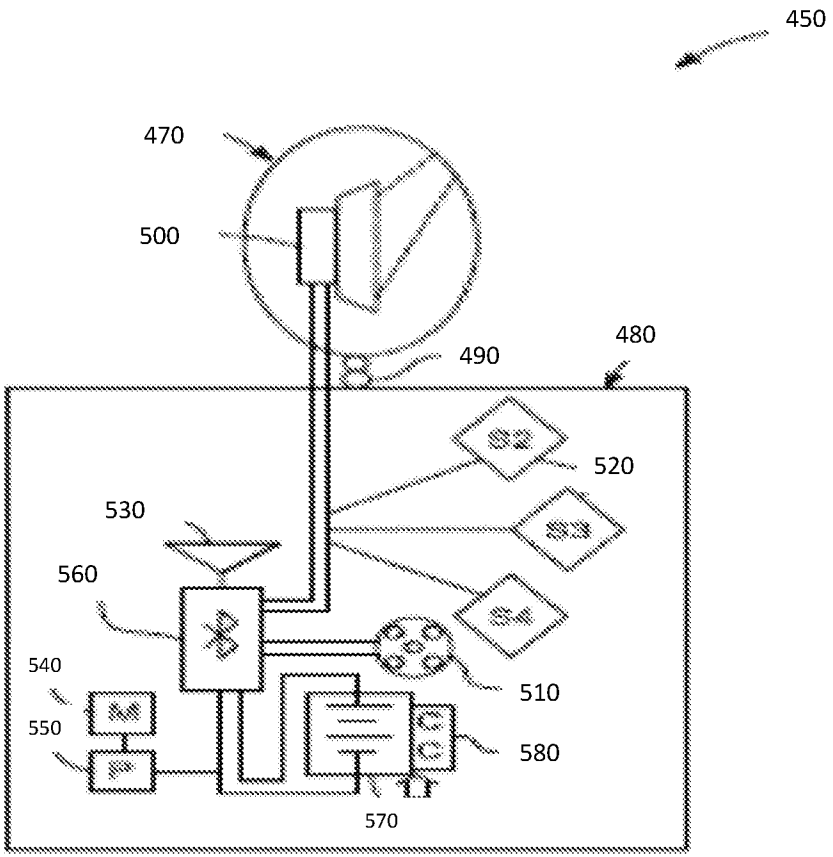
FIG. 5 illustrates a detailed schematic representation of internal structure of the exemplary wireless connected jewellery device in accordance with an embodiment of the present disclosure; and Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present invention so as not to obscure the figures with details that will be readily apparent to those skilled in the art having the benefit of the description herein.

FIG. 5 illustrates a schematic representation of an embodiment 450 of wireless connected jewellery device 30 in accordance with an embodiment of the present disclosure. In such embodiment 450, the one or more casings 460 shown in FIG. 4 may be split in to a first casing 470 and a second casing 480. The second casing 480 is operatively coupled with the first casing 470 using a conducting material 490. The first casing 470 includes a sound production system 500 substantially similar to the sound production system 170 of FIG. 2.

The second casing 480 includes a microphone device 510, a plurality of transducers 520, a transceiver antenna 530, a memory 540, a processor 550, a Bluetooth device 560, a rechargeable battery 570 and a charging circuit 580 which is substantially similar to the first microphone device 190, the plurality of transducers 280, the transceiver antenna 240, the memory 300, the processor 310, the Bluetooth device 230, the rechargeable battery 210 and the onboard charging circuit 220 of FIG. 2 respectively.

The various embodiments of the wireless connected jewellery device described above enable the audio channel design to directly transfer the plurality of sound waves to the ear canal. Hence, the device has less potential to cause health issues due to the prolonged exposure to electro-magnetic waves very close to the brain.

Also, the device is very light weight, and permeable to the wireless electromagnetic waves. The small spherical or cuboidal shape of device makes the casing area smaller and the device lighter and is easier to wear anchored to the earlobe.

Furthermore, the third casing of the one or more earrings may be used to house a transceiver antenna which reduces the overall weight of the earring and increases the range of the Bluetooth.

Moreover, the wireless connected jewellery device is wearable on the earlobes and has no connection to the ear canal. Hence, the device does not cause ear canal pain for the wearer. Further, such device does not isolate the person from the surroundings. Surrounding sound being blocked off by the earbuds have caused traffic accidents and other types of accidents.

The wireless connected jewellery device is wearable on the earlobes and has no connection with the ear sizes of different people. Hence, such device has no size constraint for different people of different ear canal sizes.

Additionally, the microphone in the one or more casings is located facing forward towards the mouth to receive spoken sound waves. Hence, there is no need to move the microphone closer to the mouth each time for speaking and maintain such position during the call.

It will be understood by those skilled in the art that the foregoing general description and the following detailed description are exemplary and explanatory of the invention and are not intended to be restrictive thereof.

While specific language has been used to describe the invention, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

We claim:

1. A wireless connected jewellery device comprising:

a pair of earrings comprising at least one of a pair of dangler earrings and a pair of drop earrings wherein the pair of earrings further comprises:

a first earring comprising: a first casing physically coupled with a first earlobe of a first ear, wherein the first casing comprises a sound production system located outside a first ear canal on the first earlobe and proximate to an intertragical notch of the first ear and wherein the first casing further comprises an audio channel design that is configured to direct a plurality of sound waves generated by the sound production system to the intertragical notch and towards the ear canal; a second casing operatively coupled with the first casing using a first litz wire as conducting material; wherein the second casing further comprises: a first microphone device located proximate to the first ear and configured so as to be forward facing to receive voice signals; a transceiver antenna proximate to the first ear and configured to transmit and receive wireless signals;

a second earring, wherein the second earring comprises: a third casing coupled with a second earlobe of a second ear; and a fourth casing coupled with the third casing using a second litz wire as a conducting material, wherein the third casing and the fourth casing comprise a plurality of transducers configured to perform a corresponding one or more functions;

wherein the first earring and the second earring are different in that they do not contain identical circuitry; and wherein the first and second casings are configured so as to be arranged on the front side of the first ear and the third and fourth casings are configured so as to be arranged on the front side of the second ear.

2. The system of claim 1, wherein the transceiver antenna is enclosed in one or more of the first, second, third, or fourth casings.

3. The system of claim 1, wherein the transceiver antenna located proximate to the first ear is located at a distance of at least 1 inch from the brain.

4. The system of claim 1, wherein the second casing of the first earring comprises a second microphone device configured for noise cancellation.

5. The system of claim 1, wherein the second casing of the first earring comprises a rechargeable battery and an onboard charging circuit.

6. The system of claim 5 wherein the rechargeable battery is further configured so as to be recharged independent of the first earring.

7. The system of claim 1, wherein the second casing of the first earring comprises a Bluetooth device (chip) configured for wireless connectivity.

8. The system of claim 7 wherein the Bluetooth device is further communicatively coupled to an external wearable communication device.

9. The system of claim 8 wherein the external wearable communication device further comprises at least one of a smart watch, a custom wearable recharger device with computing, and/or a Bluetooth mesh.

10. The system of claim 1, wherein the second earring comprises a memory configured to store short term or medium-term data obtained from the plurality of transducers.

11. The of claim 1, wherein the second earring comprises a processor configured to process data obtained from the plurality of transducers.

12. The system of claim 1, wherein the plurality of transducers comprises one or more biometric sensor of a face recognition sensor, a fingerprint sensor, an Iris recognition sensor, a voice recognition sensor, or a heart rate monitor.

13. The system of claim 1, wherein the plurality of transducers comprises one or more environmental sensors such as temperature sensor, humidity sensor, $CO_2$ level sensor and an accelerometer.

14. The system of claim 1, wherein the plurality of transducers comprises a tap sensor located at any of the casings of the pair of earrings.

15. The system of claim 1, wherein the fourth casing of the second earring comprises a Bluetooth device.

16. The system of claim 1, wherein the first casing and the second casing of the first earring and the third casing and the fourth casing of the second earring composed of a plastic with custom optimized coatings and one or more openings for jewellery aesthetics and permeability to wireless waves like bluetooth.

* * * * *